United States Patent [19]

Lambert, Sr.

[11] 4,010,947

[45] Mar. 8, 1977

[54] VARIABLE WEIGHT EXERCISE MACHINE

[76] Inventor: Lloyd J. Lambert, Sr., 1538 College Ave., Houston, Tex. 77034

[22] Filed: Apr. 18, 1975

[21] Appl. No.: 569,206

[52] U.S. Cl. ..... 272/118; 308/6 B; 272/144

[51] Int. Cl.[2] ..... A63B 21/06

[58] Field of Search ..... 272/81, 83 R, 82, DIG. 4, 272/DIG. 5, 58, 117, 118, 136–138, 140–142, 83, 134, 144; 308/6 B

[56] References Cited

UNITED STATES PATENTS

| | | | |
|---|---|---|---|
| 3,116,062 | 12/1963 | Zinkin | 272/58 |
| 3,912,263 | 10/1975 | Yatso | 272/118 |
| 3,971,555 | 7/1976 | Mahnke | 272/118 |
| R28,066 | 7/1974 | Marcyan | 272/81 |

FOREIGN PATENTS OR APPLICATIONS

| | | | |
|---|---|---|---|
| 1,444,065 | 5/1966 | France | 272/81 |

*Primary Examiner*—Richard C. Pinkham
*Assistant Examiner*—William R. Browne
*Attorney, Agent, or Firm*—Victor J. Evans & Co.

[57] ABSTRACT

The present invention relates to a variable weight exercise machine which includes vertical frame members and in which a carriage is spaced from said frame members and is mounted for vertical reciprocation only on a pair of spaced parallel vertical guide bars extending through the carriage and through a plurality of weights below the carriage. Linear bearings in the carriage engage the guides. A central shaft is suspended from the carriage and extends through a central bore in the weights with any number of the weights being detachably connected to the shaft by a transverse pin extending through one of the weights and the shaft. Spring cushions the weight as it reaches the lower end of its travel. A pair of grasping arms including handles extend outwardly from the carriage for the exercisor to grasp during the exercise. The grasping handles can be attached to the top or the bottom of the carriage for different types of exercises.

6 Claims, 9 Drawing Figures

VARIABLE WEIGHT EXERCIXE MACHINE

BACKGROUND OF THE INVENTION

Field of the Invention

The present invention relates to a variable weight lifting exercise machine.

SUMMARY OF THE INVENTION

A carriage is *mounted for* vertical reciprocation on a pair of spaced parallel guide members extending through the carriage. Weights are mounted for reciprocation on the guide members and have a central bore to receive a shaft depending from the carriage. A transverse pin is adapted to extend through a selected one of the weights and the shaft to provide a variable weight load on the carriage. Arms with handles on their ends are detachably secured to the upper or lower end of the carriage for grasping by the exercisor to raise and lower the weights.

The primary object of the invention is to provide a compact exercise machine having variable weight elments associated therewith.

Other objects and advantages will become apparent in the following specification when considered in light of the attached drawings.

DESCRIPTION OF THE PREFERRED EMBODIMENT

Figure 1:
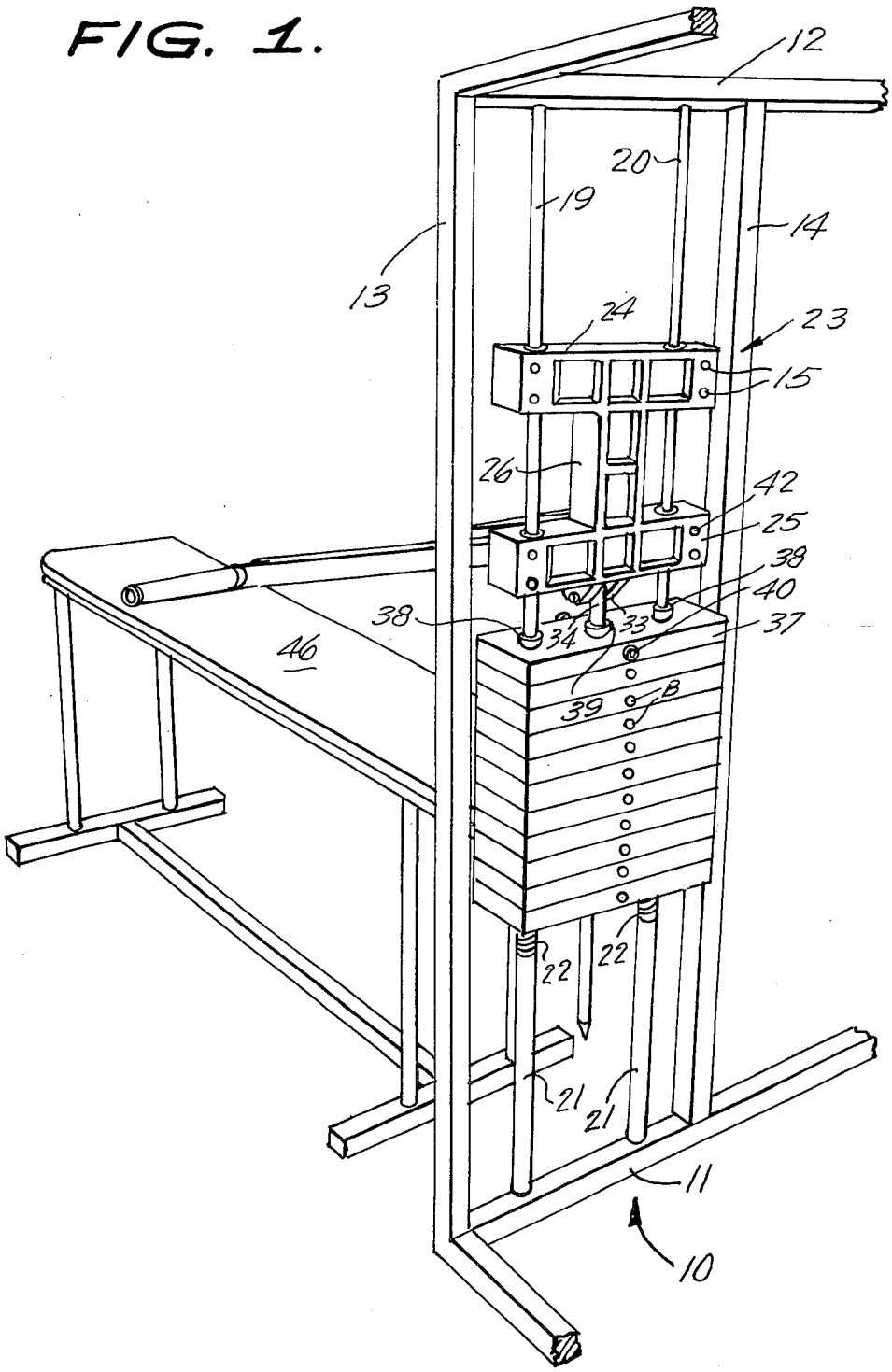
FIG. 1 is a perspective view of the invention.

Referring now to the drawings in detail, wherein like reference characters indicate like parts throughout the several figures, the reference numeral 10 indicates generally an exercise machine constructed in accordance with the invention.

The exercise machine 10 includes a base frame 11, and an upper frame 12 parallel to the base frame 11. A pair of spaced upright frame members 13, 14 extend from the base frame 11 to the upper frame 12 as can be seen in FIG. 1. Transverse frame members 15, 16 support the frame members 11, 12, 13, 14.

Figure 2:
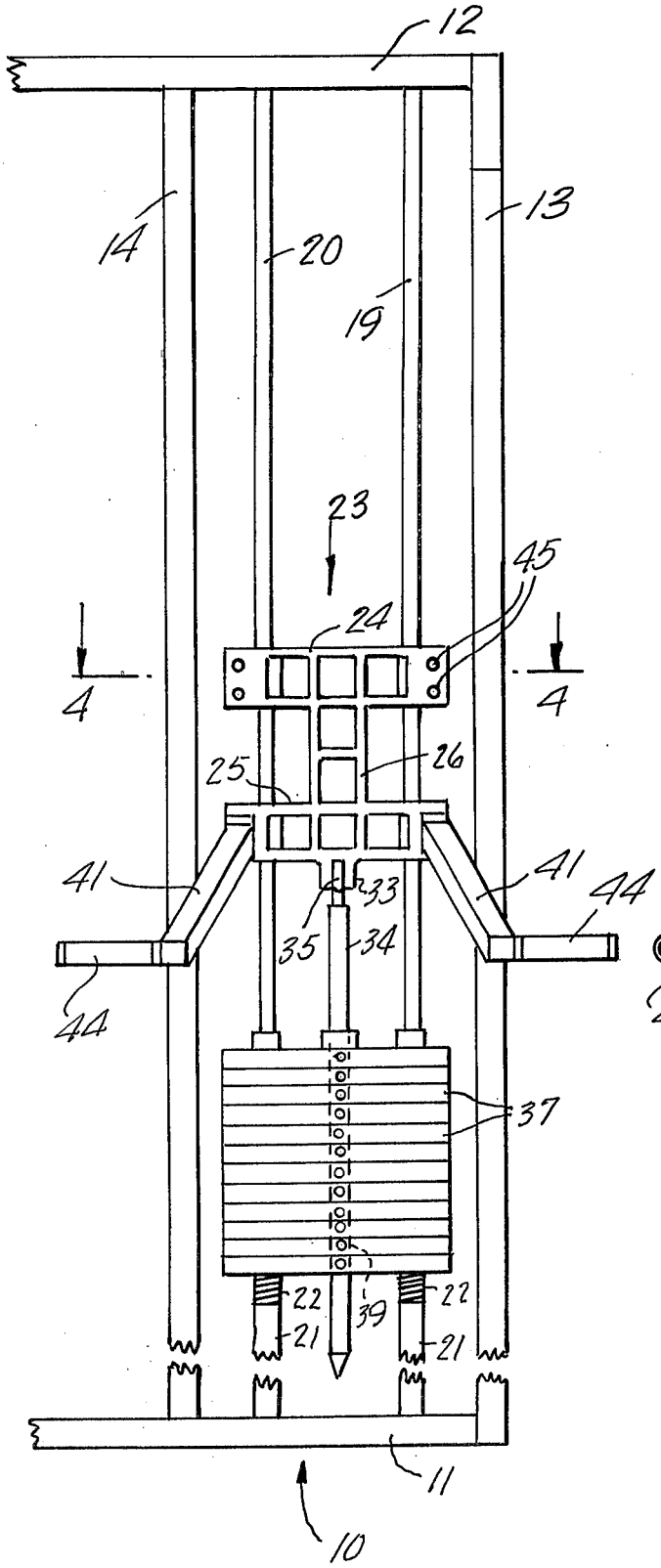
FIG. 2 is a front elevation of the invention.
Figure 3:
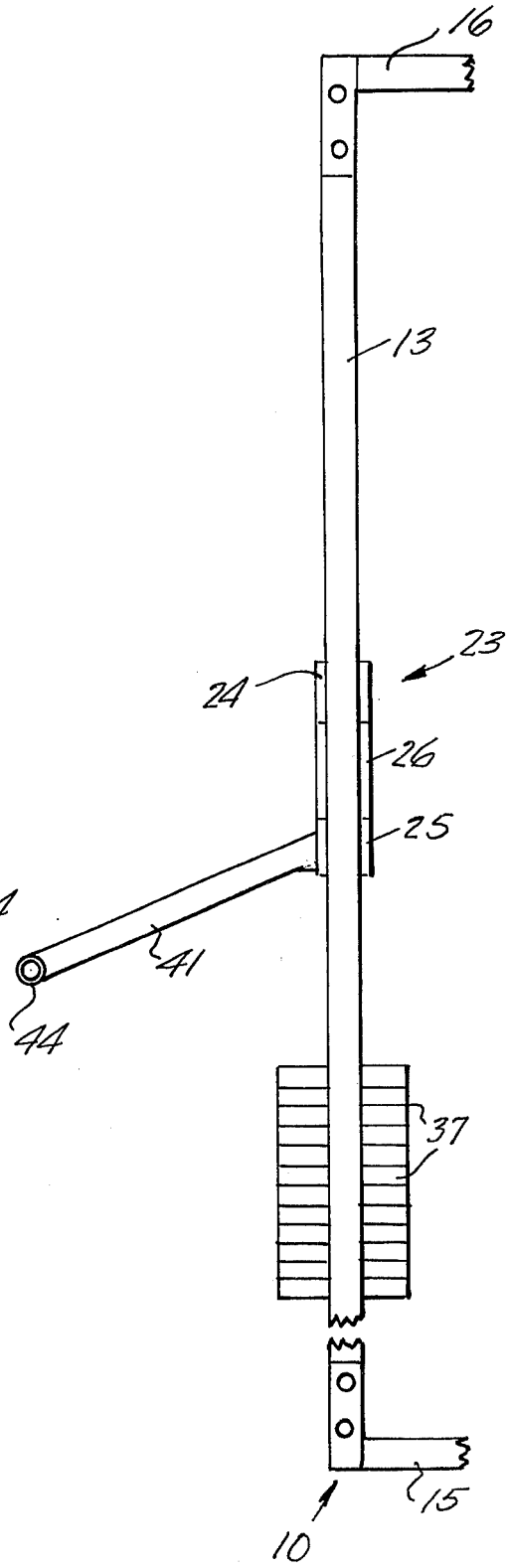
FIG. 3 is a side elevation of the invention.
Figure 4:
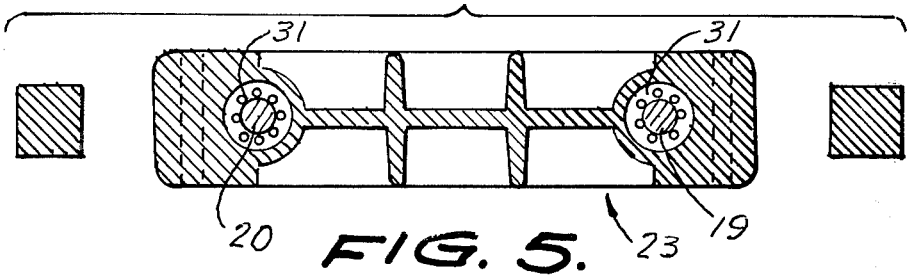
FIG. 4 is an enlarged fragmentary transverse sectional view taken along the line 4—4 of FIG. 2 looking in the direction of the arrows.
Figure 5:
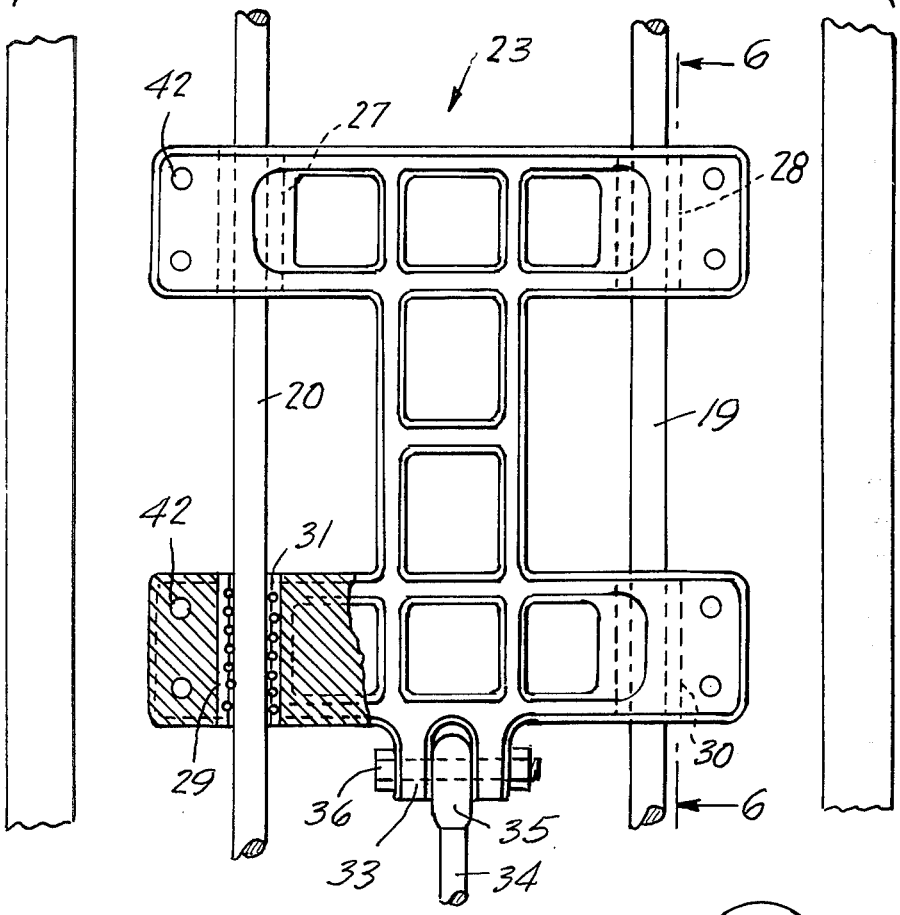
FIG. 5 is an enlarged fragmentary front elevation of the carriage shown partially broken away and in section for convenience of illustration.
Figure 6:
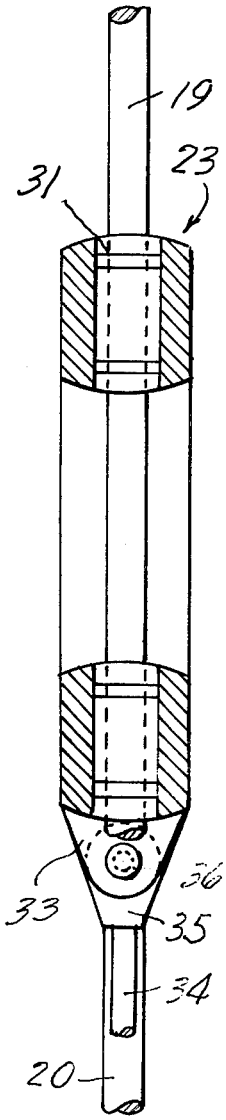
FIG. 6 is a vertical sectional view taken along the line 6—6 of FIG. 5 looking in the direction of the arrows.
Figure 7:
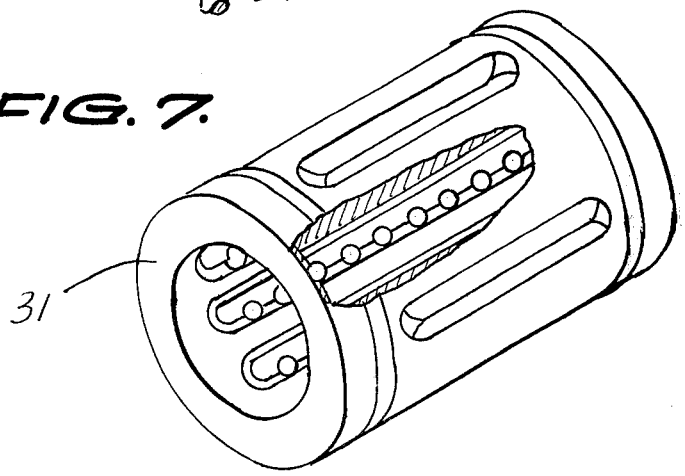
FIG. 7 is a perspective view of the linear bearing removed from the carriage and partially broken away for convenience of illustration.
Figure 8:
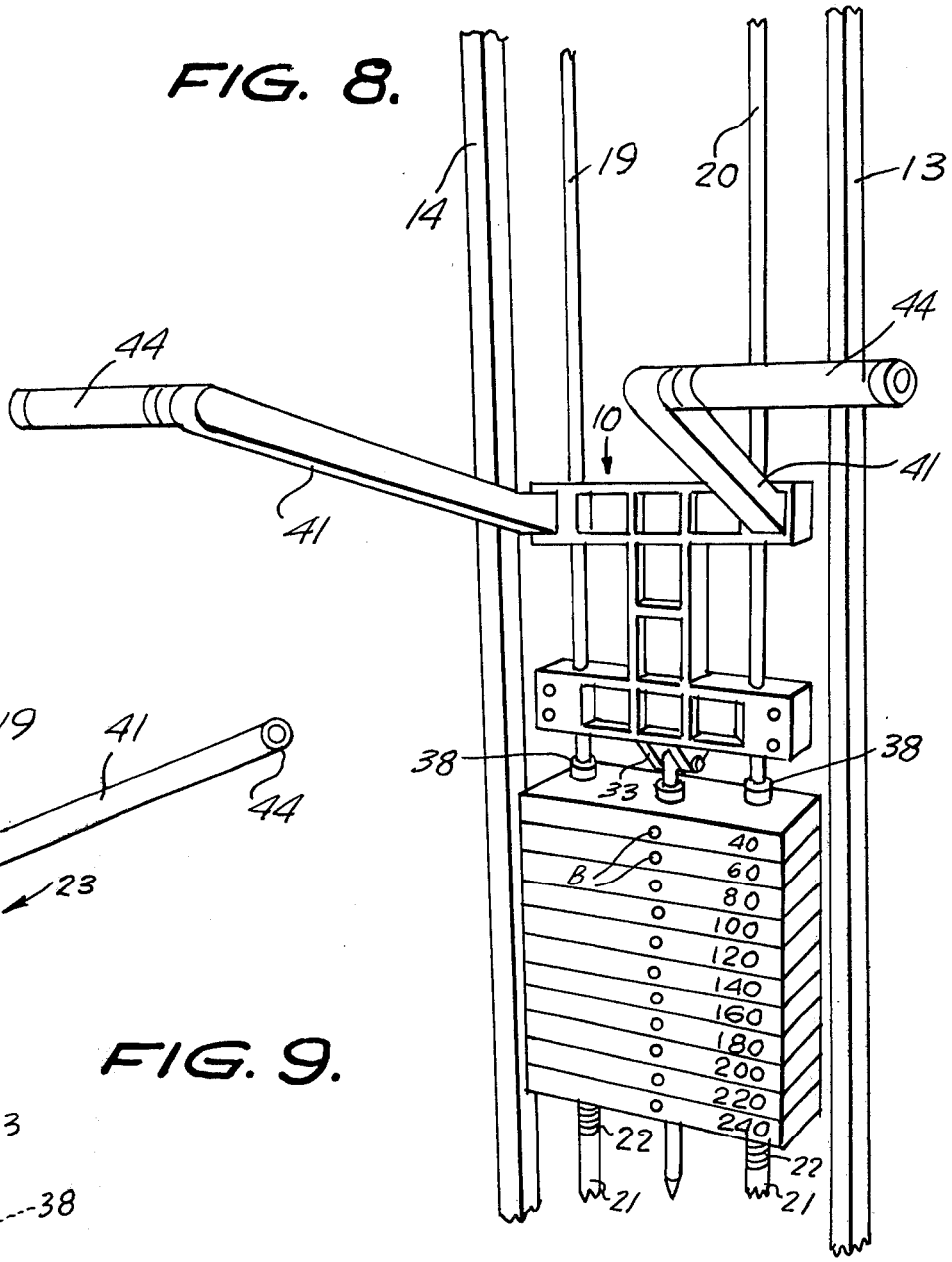
FIG. 8 is a fragmentary perspective view of the invention with the weight lift handles secured to the upper part of the carriage.
Figure 9:
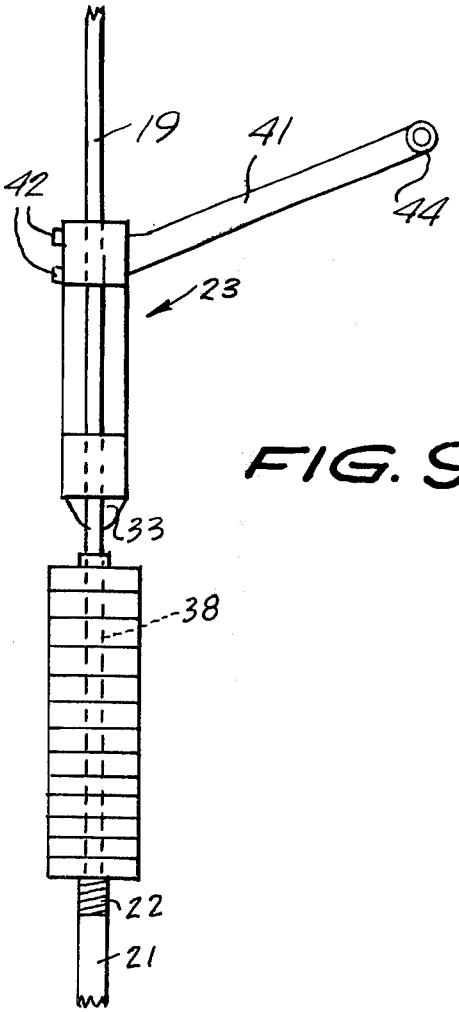
FIG. 9 is a fragmentary side elevation of the structure illustrated in FIG. 8.

A pair of cylindrical guides 19, 20 are arranged in spaced parallel relation between the frame members 13, 14 and are secured at their lower ends to the frame member 11 and their upper ends to the frame member 12. The guides 19, 20 each have a tubular member 21 encompassing the lower end thereof as can be clearly seen in FIGS. 1 and 2. A compression coil spring 22 encompasses the guides 19, 20 and rests on the upper ends of the tubular members 21.

An H-frame carriage generally indicated at 23 is positioned between the frame members 13, 14 and is provided with an upper horizontal bar 24, a lower horizontal bar 25 and a vertical bar 26 extending between and integrally connecting the horizontal bars 24, 25.

The upper horizontal bar 24 is provided with spaced parallel bores 27, 28 for engaging respectively about the guides 19, 20 and a lower horizontal bar 25 is provided with bores 29, 30 for similarly engaging about the guides 19, 20. The bores 27, 28, 29, 30 have a diameter substantially greater than the diameter of the guides 19, 20 to support linear ball bearings 31 riding on the guides 19, 20.

A yoke 33 is formed on the lower end of the horizontal bar 25 and a shaft 34 is provided with an eye 35 mounted in the yoke 33 by means of a yoke pin 36. The shaft 34 has a plurality of spaced parallel generally horizontal bores (not shown) extending therethrough. A plurality of weight plates 37 are each provided with spaced parallel bores 38 to engage over the guides 19, 20. Each of the weight plates 37 have a generally horizontal bore B centrally positioned therein said extending transversely thereof. A vertical bore 39 extends through each of the weight plates 37 to permit the shaft 34 to engage therethrough. A transverse pin 40 is adapted to engage through the bore 38 in a selected one of the weights 37 and through the shaft 34 to secure the selected weight 37 and those above it to the shaft 34.

An arm 41 is secured to each end of the bar 25 by means of a pair of bolts 42 which extend through spaced parallel generally horizontal bores 43 in the opposite ends of the horizontal bar 25. Handles 44 extend outwardly from the arms 41 to be grasped by the hands of the exercisor. The bar 24 has bores 45 arranged in vertically spaced relation on opposite ends thereof to receive the bolts 42 so that the arms 41 may be secured to the upper portion of the carriage 23 to vary the type of exercise possible with the machine 10. The arms 41 are arranged to slope downwardly or upwardly from their respective positions of attachment as desired by the user.

In some types of exercises wherein the exercise machine 10 is employed, a weight lifter's bench 46 is positioned adjacent the exercise machine 10 so that the exercisor may be prone or sitting during the exercise.

In the use and operation of the invention the exercisor positions himself alongside of the frames 13, 14 in a position to grasp the handles 44. The pin 40 is inserted in a selected hole 38 so as to secure the shaft 34 to the desired number of the weight plates 37. The handles 44 are then raised and lowered the desired number of times with the springs 22 supported on the tubular members 21 serving to cushion the force of the weight plates 37 as they reach the lower end of their travel. By varying the position of the arms 41 on the carriage 23 the exercise machine 10 can be adapted to a number of different exercises.

Having thus described the preferred embodiment of the invention it should be understood that numerous structural modifications and adaptations may be resorted to without departing from the spirit of the invention.

What is claimed is:

1. An exercise machine comprising a pair of vertical frame members arranged in spaced parallel relation, a pair of spaced parallel vertical guide members positioned between said frame members, a carriage arranged for vertical reciprocation between said frame members, anti-friction means on said carriage engaging about said guide members for guiding said carriage for vertical reciprocation, said carriage being spaced from said frame members and guided only by said guide members, a plurality of weights mounted for vertical sliding movement on said guide members beneath said carriage and rigid means depending from said carriage for selective connection to said weights for moving the connected weights with said carriage on vertical sliding movement of said carriage, a pair of arms detachably connected to opposite sides of said carriage and a pair of handles secured to said arms for moving said carriage vertically between said frames.

2. A device as claimed in claim 1 wherein said arms extend at an angle to the horizontal from said carriage supporting the weights and can be detachably connected at vertically spaced points on said carriage.

3. A device as claimed in claim 1 wherein the means depending from said carriage for connection to said weights comprises a shaft secured to said carriage at the upper end of the shaft and extending through bores in said weight plates, said shaft having the weights at its mid portion and its lower end free.

4. A device as claimed in claim 3 including a transverse pin for detachably connecting said weight plates to said shaft.

5. A device as claimed in claim 1 wherein the anti-friction means on said carriage engaging said guide members, comprises a pair of linear tubular ball bearings on the upper end of said carriage completely surrounding the guide members and a pair of linear ball bearings on the lower end of said carriage.

6. A device as claimed in claim 1 including compression spring shock absorbers on the lower ends of said guide members for cushioning the downward movement of said weight plates and for supporting said weight plates when at rest.

* * * * *